US007780467B2

(12) United States Patent
Daily

(10) Patent No.: US 7,780,467 B2
(45) Date of Patent: Aug. 24, 2010

(54) POKE-IN CONNECTOR

(75) Inventor: Christopher George Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/211,991

(22) Filed: Sep. 17, 2008

(65) Prior Publication Data

US 2010/0068925 A1 Mar. 18, 2010

(51) Int. Cl.
*H01R 11/20* (2006.01)

(52) U.S. Cl. ..... 439/440

(58) Field of Classification Search ..... 439/439–441, 439/567; 200/295
See application file for complete search history.

(56) References Cited

U.S. PATENT DOCUMENTS

| | | | | |
|---|---|---|---|---|
| 3,214,722 | A * | 10/1965 | Weimer, Jr. | 439/441 |
| 3,805,211 | A * | 4/1974 | Moore | 439/101 |
| 5,260,678 | A | 11/1993 | Van Wagener | |
| 5,348,491 | A | 9/1994 | Louwagie | |
| 5,350,292 | A | 9/1994 | Sanders | |
| 5,482,469 | A | 1/1996 | Seiceanu | |
| 5,577,924 | A | 11/1996 | Louwagie | |
| 5,677,830 | A * | 10/1997 | Nogas et al. | 361/790 |
| 5,816,864 | A | 10/1998 | Creelle | |
| 5,865,654 | A | 2/1999 | Shimirak | |
| 5,967,838 | A | 10/1999 | Wozniczka | |
| 6,068,502 | A * | 5/2000 | Kuo | 439/353 |
| 6,099,349 | A * | 8/2000 | Boutros | 439/541.5 |
| 6,179,655 | B1 | 1/2001 | Wozniczka | |
| 6,398,593 | B1 | 6/2002 | Yeh | |
| 6,848,948 | B1 | 2/2005 | Khemakhem | |
| 7,074,080 | B1 | 7/2006 | Khemakhem | |
| 7,083,469 | B1 | 8/2006 | Khemakhem | |
| 7,226,313 | B2 | 6/2007 | Shamoto | |
| 7,371,124 | B2 | 5/2008 | Khemakhem | |
| 2006/0110986 | A1 * | 5/2006 | King et al. | 439/709 |
| 2007/0178747 | A1 * | 8/2007 | Schrader | 439/441 |

FOREIGN PATENT DOCUMENTS

DE 37 43 410 A1 * 6/1989

* cited by examiner

*Primary Examiner*—Renee Luebke
*Assistant Examiner*—Larisa Tsukerman

(57) ABSTRACT

A connector having a housing and a contact are described. The connector includes an electrically conductive contact and a housing. The housing has a cavity to receive and secure the contact, a first alignment feature for receiving a first conductive cable into the contact and a second alignment feature for receiving a second conductive cable into the contact. The housing also includes at least one attachment point protruding from the housing to attach and secure the connector to a surface and at least one flexible flange to substantially prevent movement of the connector on a surface. The contact receives and secures the first conductive cable and the second conductive cable to provide an electrical connection between the first conductive cable and the second conductive cable. The attachment point attaches and secures the connector to a surface.

18 Claims, 10 Drawing Sheets

POKE-IN CONNECTOR

FIELD OF THE INVENTION

The present invention is directed to a poke-in style connector. More specifically, the present invention is directed to a poke-in style connector having an attachment feature that can snap into a substrate or surface.

BACKGROUND OF THE INVENTION

Electrical applications may require the use of electrical connectors to form electrical connections between various electrical devices in the application. Often, the connectors are soldered or otherwise secured to a substrate such as a printed circuit board, mounting plate or other suitable base. However, these types of connectors require the use of tools and/or complex methods to initiate and secure the connection. The use of tools and/or complex methods to make the connection is time consuming, as well as expensive. Further, these types of connections are often permanent and may prevent the replacement of any other components at a later time.

Therefore, there is a need for an electrical connector that does not require fasteners, tools, and/or a complex method to secure the connector to a substrate such as a circuit board, mounting plate or other suitable base. What is further needed is a connector that facilitates the insertion of conductive cables without the aid of tools or other equipment, and a connector that securely retains the conductive cable or other conductive device after the cable or other conducive device is inserted.

SUMMARY OF THE INVENTION

One embodiment is directed to a connector including a housing and at least one contact. The connector includes an electrically conductive contact and a housing. The housing has a cavity to receive and secure the contact, a first alignment feature for receiving a first conductive cable into the contact and a second alignment feature for receiving a second conductive cable into the contact. The housing also includes at least one attachment point protruding from the housing to attach and secure the connector to a surface and at least one flexible flange to substantially prevent movement of the connector on a surface. The contact receives and secures the first conductive cable and the second conductive cable to provide an electrical connection between the first conductive cable and the second conductive cable. The attachment point attaches and secures the connector to a surface.

Another embodiment is directed to a connector including a housing and at least one contact. The connector includes an electrically conductive contact and a housing. The housing has a cavity to receive and secure the contact, a first alignment feature for receiving a first conductive cable into the contact and a second alignment feature for receiving a second conductive cable into the contact. The housing also includes at least one attachment point protruding from the housing to attach and secure the connector to a surface. The contact receives and secures the first conductive cable and the second conductive cable to provide an electrical connection between the first conductive cable and the second conductive cable. The attachment point attaches and secures the connector to a surface.

An advantage of the present invention is that the connector includes a poke-in contact that provides a quick and easy connection to a wire, cable or other electrical device.

Another advantage of the present invention is that the connector does not require fasteners to secure to a substrate or surface.

Yet another advantage of the present invention is that the connector housing is manufactured by an injection molding process, thereby reducing manufacturing costs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
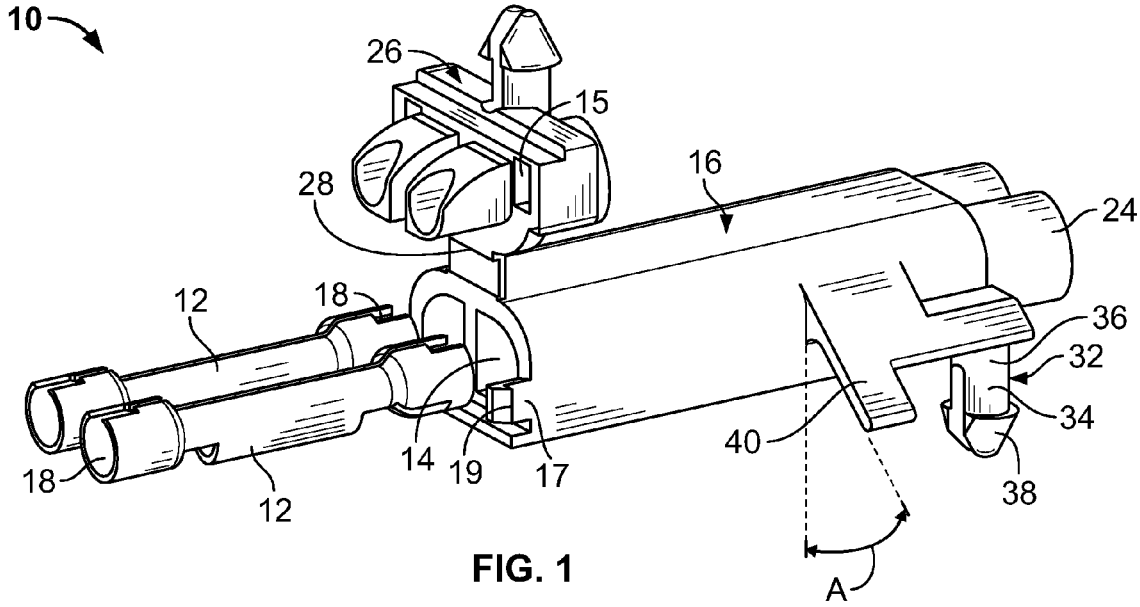
FIG. 1 shows a partially exploded view of a dual ended poke in connector in accordance with an embodiment of the present invention.

The present invention will now be described more fully hereinafter with reference to the accompanying drawings in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Referring to FIGS. 1, 2, 3 and 4, an exemplary embodiment of a poke-in connector (hereinafter referred to as "connector") 10 is shown. Connector 10 includes a housing 16 and a contact 12. Housing 16 includes a cavity 14 for receiving contact 12. Housing 16 may be formed by an injection molding process, or any other suitable process used to manufacture a non-conductive material, such as plastic. Housing 16 may have a generally rectangular configuration or any other suitable configuration to receive and secure contact 12, while also being configured for placement in an environment, including space-limited areas. In this exemplary embodiment, housing 16 includes two cavities 14 configured to receive two contacts 12, however, in an alternative embodiment, housing 16 may include one or more cavities configured to receive one or more contacts 12. In another embodiment, a cavity may be configured to receive one or more contacts 12.

Contact 12 may be secured in cavity 14 through the use of tabs, slots and holes formed and aligned in contact 12 and housing 16. For example, housing 16 may include a tab or a series of tabs that mate with a slot or series of slots formed in contact 12. The tabs are dimensioned to securely fit into the slots and prevent movement of contact 12. In addition, an adhesive may be used in conjunction with or independent of the slots and tabs to secure contact 12 in cavity 14. Further, cavity 14 may have dimensions suitable to secure contact 12 once contact 12 is inserted into cavity 14 without the use of adhesive, slots or tabs.

Housing 16 further includes an alignment feature 24 for receiving and guiding conductive cables 60 (See FIG. 15) into cavities 14. In this exemplary embodiment, an alignment feature 24*a* is integrally formed on one end of the housing 16, and an opposing alignment feature 24*b* is disposed on an opposing end of the housing 16. The alignment feature 24*b* is integrally formed with a cover 26 that is hingedly attached to housing 16 by a living hinge 28 or any other suitable hinge or fastening mechanism. Cover 26 provides access to cavity 14 for receiving contact 12. After contact 12 is inserted into cavity 14 in housing 16, cover 26 is rotated about hinge 28 to securely dispose contact 12 in housing 16.

Figure 3:
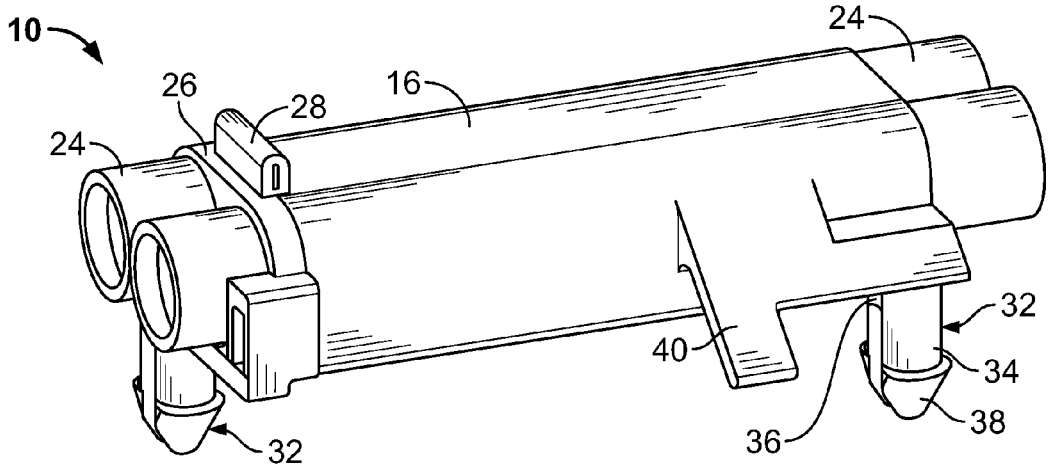
FIG. 3 shows a perspective view of the dual ended poke in connector of FIG. 1.
Figure 4:
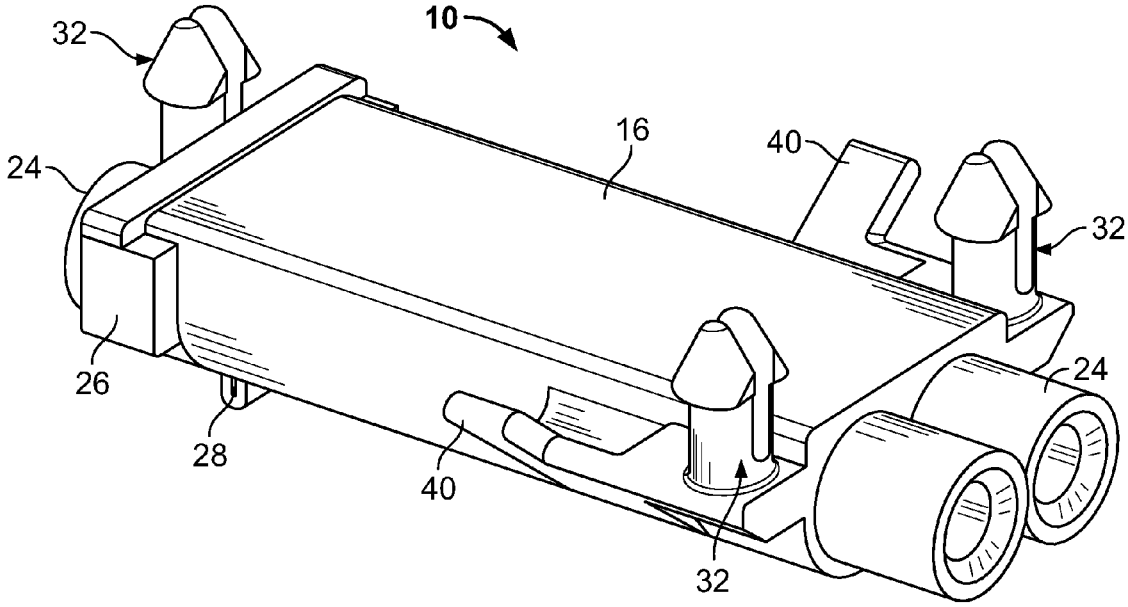
FIG. 4 shows a bottom perspective view of the dual ended poke in connector of FIG. 3.

Housing 16 also includes a latch 17 and a corresponding latch recess 15 for securing cover 26 in a closed position as shown in FIGS. 3 and 4 once cover 26 is rotated about hinge 28 to secure contacts 12 in housing 16. Latch 17 extends from housing 16 and has a engagement surface 19. Recess 15 includes a notch (not shown) for receiving and securing engagement surface 19. When cover 26 is closed about hinge 28, and latch 17 is inserted into latch cavity 15, engagement surface 19 engages the notch to secure latch 17 in recess 15 and thereby secure cover 26 to housing 16. In this exemplary embodiment, recess 15 is formed in cover 26 and latch 17 extending from housing 16, however, an another embodiment, recess 15 may be formed in housing 16 and latch 17 may extend from cover 26. Additionally, in this exemplary embodiment, housing 16 includes two latches 17 and two corresponding recesses 15, however, in another embodiment, housing 16 may include one or more latches 17 and corresponding recesses 15.

Figure 16:
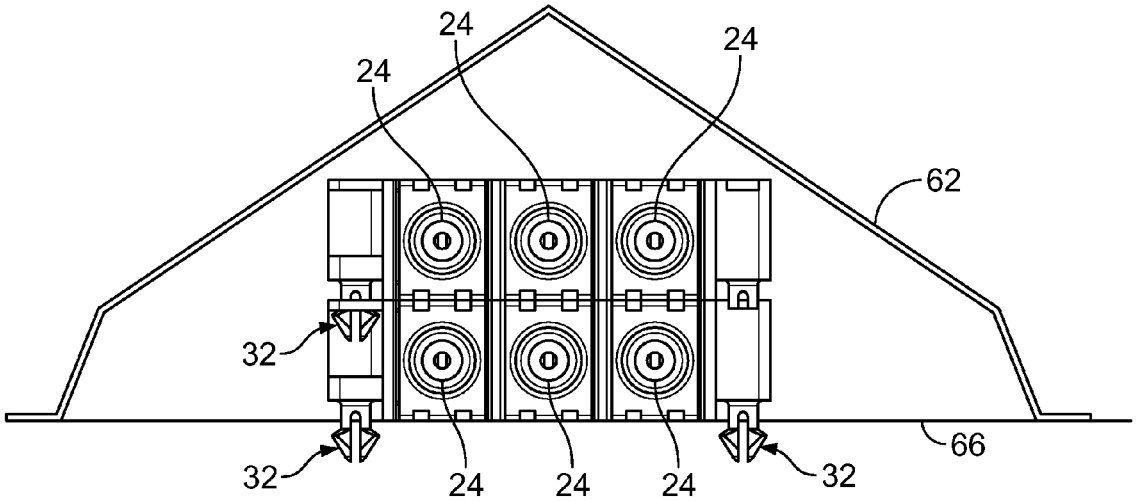
FIG. 16 shows a mounting arrangement of the connector of FIG. 14.
Figure 17:
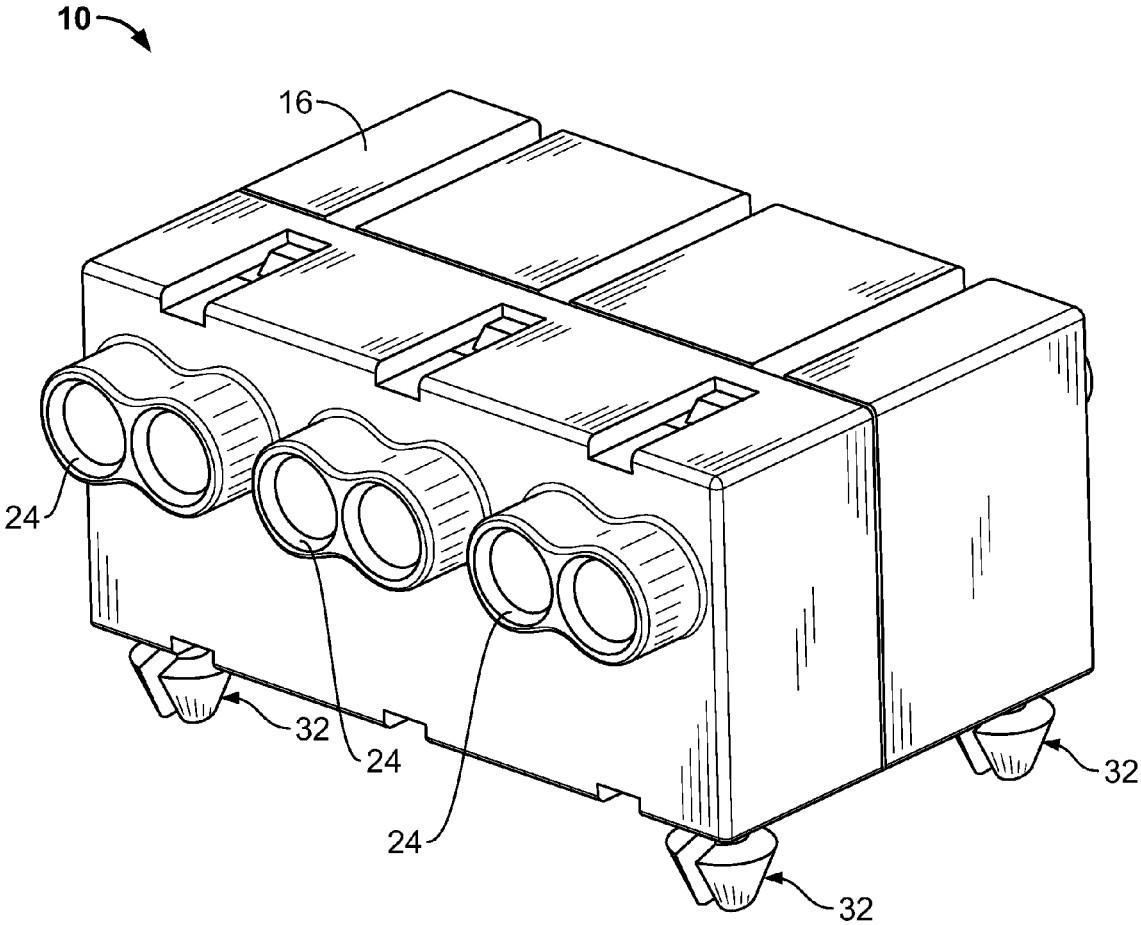
FIG. 17 shows a perspective view of an alternate embodiment of a dual ended poke in connector in accordance with an embodiment of the present invention.
Figure 18:
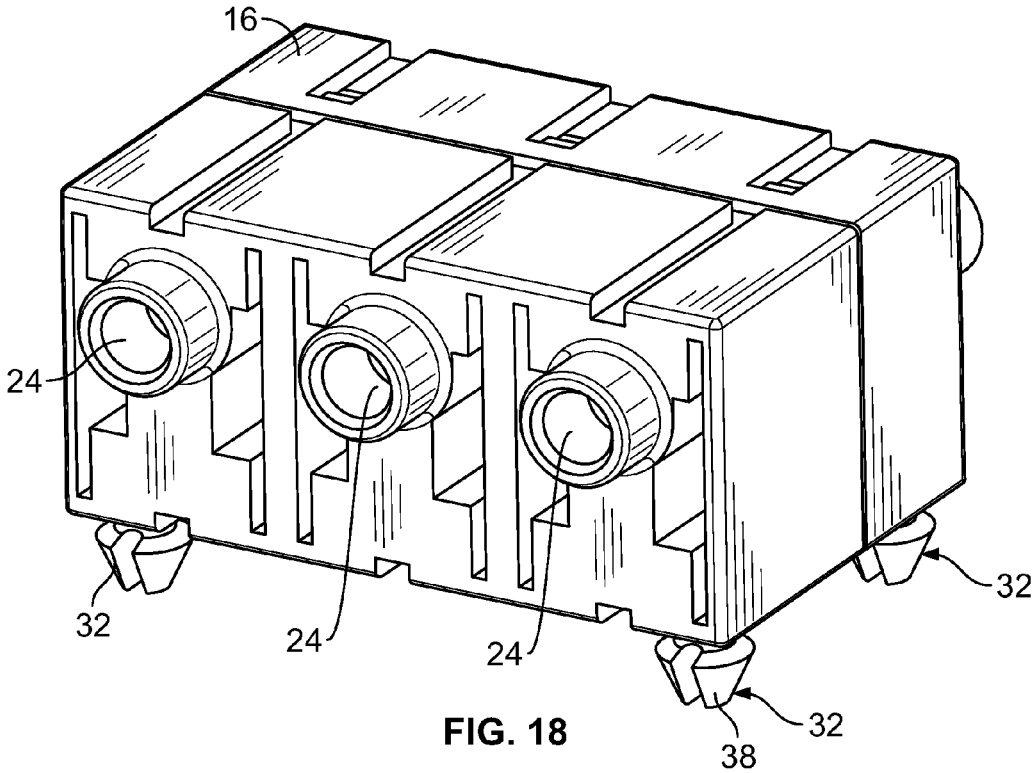
FIG. 18 shows perspective view of an opposite end of the connector of FIG. 17.
Figure 19:
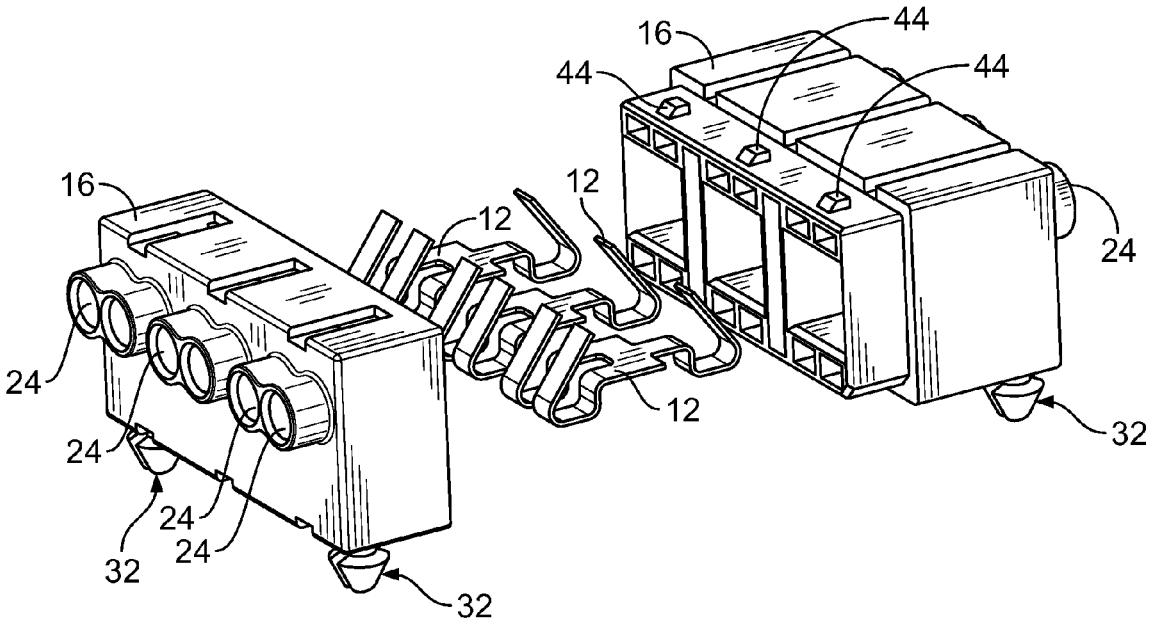
FIG. 19 shows a partially exploded view of the connector of FIG. 17.

Housing 16 further includes attachment points 32 for securing connector 10 to a substrate 66 (see FIG. 16). In this exemplary embodiment, housing 16 includes three attachment points 32. In another embodiment, housing 16 may include one or more attachment points 32. Furthermore, in this exemplary embodiment, at least one attachment point 32 is attached to cover 26. In another embodiment, no attachment points 32 are attached to cover 26. In yet another embodiment, at least one attachment point 32 is attached to housing 16.

Attachment points 32 include two substantially parallel sections 34 protruding from a base 36. Attachment points 32 further include a retention feature 38 for securely attaching the connector 10 to substrate 66 (See FIG. 16). Attachment points 32 are pressed into an opening, aperture or other receptacle feature (not shown) of substrate 66 (See FIG. 16) to securely attach the connector 10 to substrate 66. When attachment points 32 are pressed into an opening in substrate 66, parallel sections 34 are flexed or otherwise displaced inward toward each other to permit the retention feature 38 to pass though the opening. Once retention feature 38 passes through substrate 66, parallel sections 34 return to a substantially parallel position and are no longer flexed or otherwise displaced inward toward each other. Retention feature 38 then prevents connector 10 from being removed from substrate 66 without the use of a tool, device or other actuation means.

Housing 16 further includes flexible protrusions 40. Each flexible protrusion 40 protrudes from housing 16 at a predetermined angle A ranging from about zero degrees to about ninety degrees. Flexible protrusions 40 compensates for the thickness differences in varying substrates 66 (See FIG. 16) and also stabilizes housing 16 on substrate 66 to prevent movement of connector 10 on substrate 66 once attachment point 32 is secured to substrate 66. Flexible protrusions 40 rigidly angularly displace to exert a force against substrate 66 to prevent movement of connector 10 on substrate 66. When flexible protrusions 40 displace, the predetermined angle is increased, which exerts a force against substrate 66. In this exemplary embodiment, housing 16 includes two flexible protrusions 40, with each one of the two flexible protrusions 40 protruding from an opposing outside surface of housing 16. In another exemplary embodiment, the flexible protrusions may be omitted.

Figure 2:
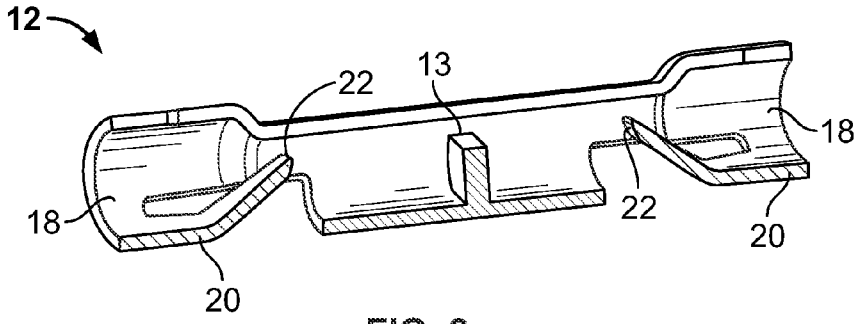
FIG. 2 shows a cross sectional view of a contact used in the connector in FIG. 1.

Referring to FIG. 2, a cross section view of contact 12 is shown. Contact 12 includes openings 18 and a lance 20. U.S. patent application Ser. No. 11/744,241, describes an embodiment for lance 20 and is hereby incorporated by reference. Lance 20 is disposed proximate each opening 18. Lance 18 is configured to deform when a conductive cable 60 (see FIG. 15) is inserted into opening 18 to allow conductive cable 60 to pass the sharp end 22 of lance 10. Sharp end 22 may be beveled or otherwise pointed to provide a sharp surface for penetration into conductive cable 60 (See FIG. 15). Once conductive cable 60 (See FIG. 15) is inserted into contact 12, lance 20 is in electrical communication with conductive cable 60 (See FIG. 15). As a removal force is applied to conductive cable 60 (See FIG. 15), sharp end 22 of lance 20 engages with conductive cable 60 (See FIG. 15) to prevent the extraction of conductive cable 60 (See FIG. 15) from contact 12. Contact 12 may be manufactured by a stamping process or any other suitable manufacturing process from any electrically conductive material suitable for electrical communication, for example, a copper alloy material. In this exemplary embodiment, contact 12 has a generally cylindrical configuration. In another embodiment, contact 12 may have any suitable configuration such as rectangular or square.

Contact 12 also includes a tab 13 disposed in contact 12. Tab 13 prevents the over insertion of conductive cable 60 (See FIG. 15) into contact 12. Tab 13 is disposed at a predetermined location within contact 12. In this exemplary embodiment, tab 13 is disposed at approximately the axial center of contact 12. In another embodiment, tab 13 may be positioned at a location other than the axial center of contact 12. In this exemplary embodiment, tab 13 is of unitary construction with contact 12. In another embodiment, tab 13 is omitted or formed of a separate component and inserted into contact 12.

Figure 5:
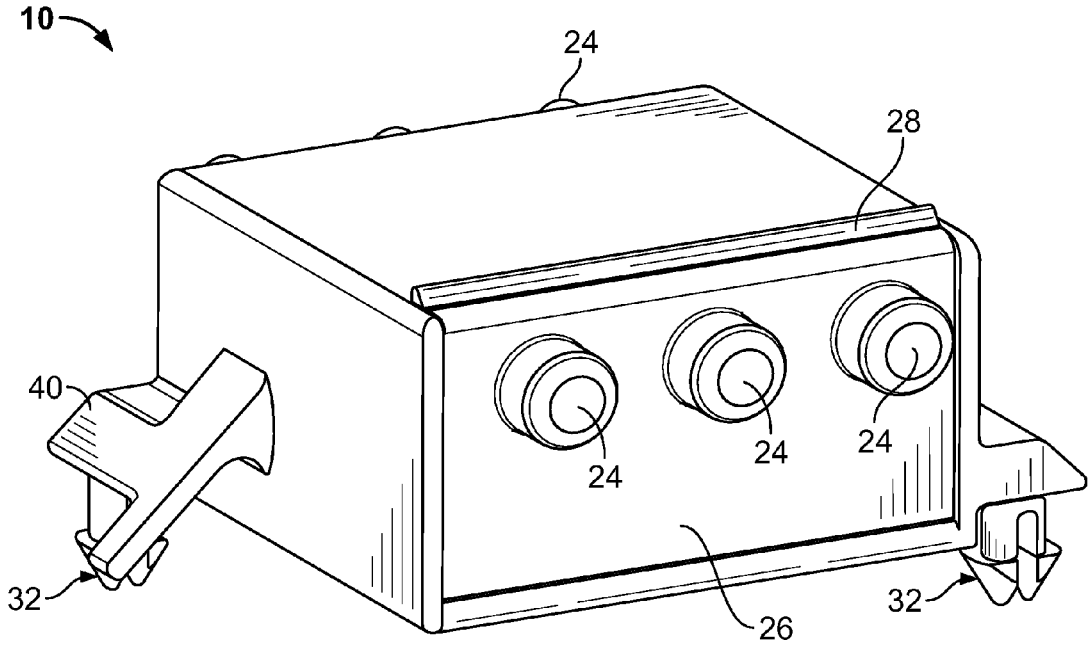
FIG. 5 shows a perspective view of an alternate embodiment of the dual ended poke in connector in accordance with an embodiment of the present invention.
Figure 6:
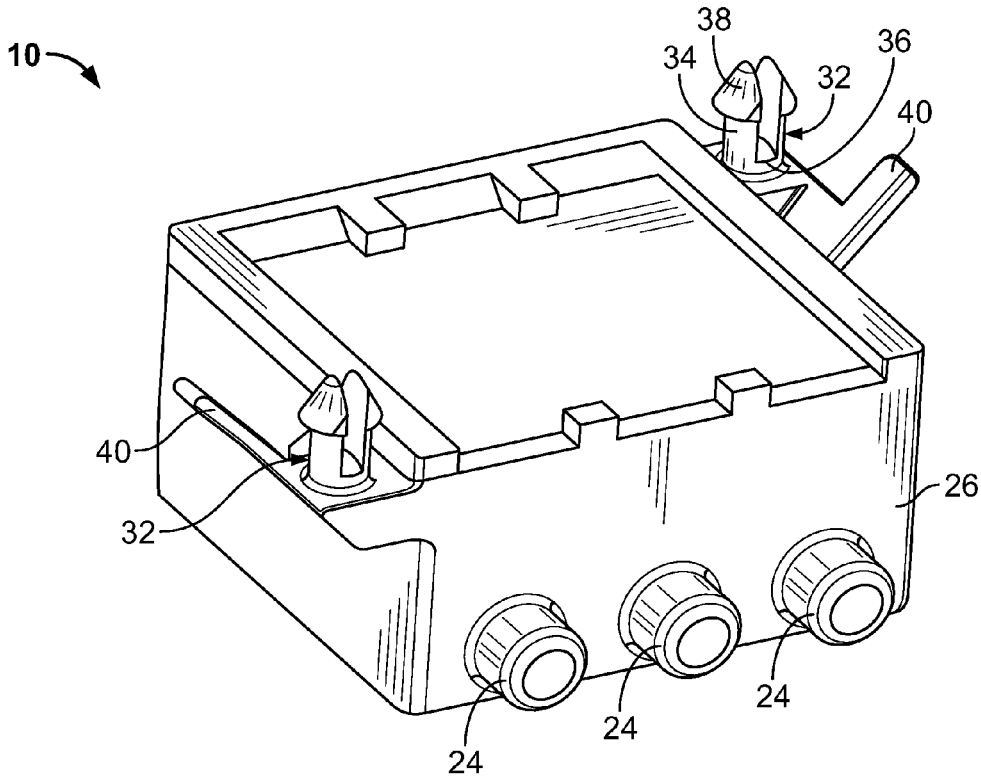
FIG. 6 shows a bottom perspective view of the dual ended poke in connector of FIG. 5.
Figure 7:
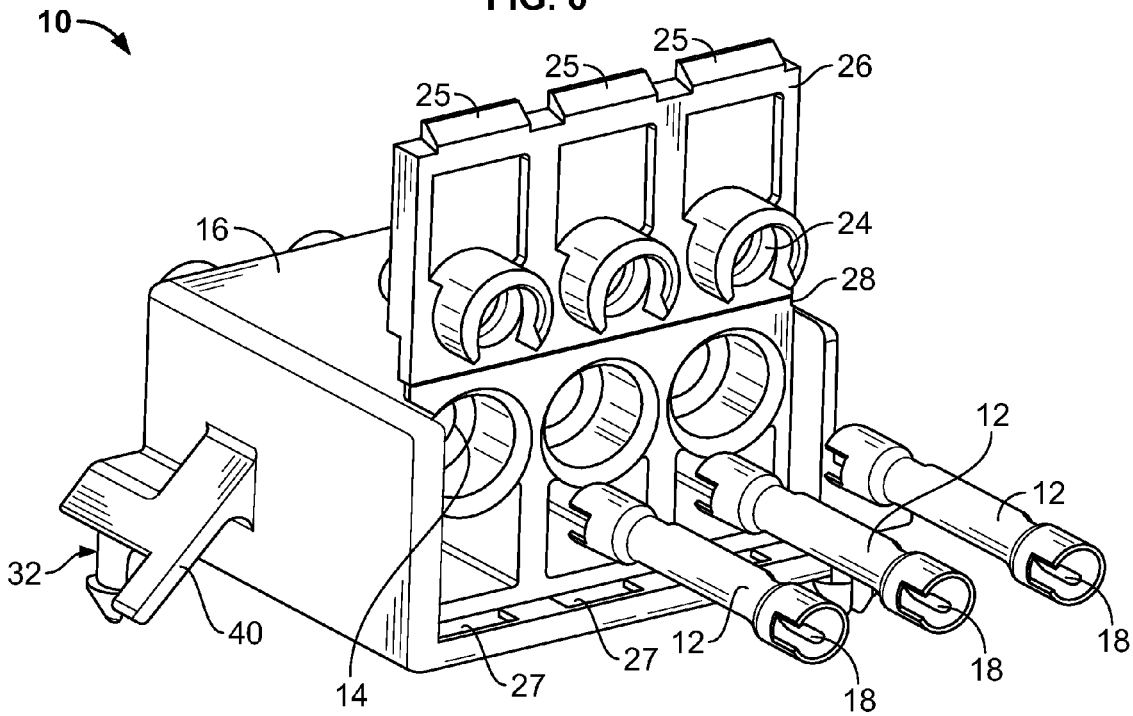
FIG. 7 shows a partially exploded view of the dual ended poke in connector of FIGS. 5 and 6.

Referring now to FIGS. 5, 6 and 7, another exemplary embodiment of connector 10 is shown. In this exemplary embodiment, connector 10 includes housing 16 having three cavities 14 for receiving three contacts 12. Housing 16 has a generally rectangular or square configuration and may be manufactured from an injection molding process from a plastic or other suitable non conductive material. Cavities 14 are dimensioned to secure contacts 12 when contacts 12 are inserted into cavities. Other securing and fastening means may be used to secure contacts 12 into cavities 14. Once contacts 12 are inserted into cavities 14, cover 26 is rotated about hinge 28 to a closed position. Cover 26 includes protrusions 25 that engage with apertures 27 in housing 16 when cover 26 is in the closed position. Once protrusions 25 are engaged in apertures 27, a tool or other suitable device may be required to remove protrusions 25 from apertures 27. Housing 16 includes an alignment feature 24 for receiving conductive cables 60 (See FIG. 15) into cavities 14. In this exemplary embodiment, an alignment feature 24*a* is integrally formed on one end of the housing 16, and an opposing alignment feature 24*b* is disposed on an opposing end of the housing 16. The alignment feature 24*b* is integrally formed with a cover 26 that is hingedly attached to housing 16 by a living hinge 28 or any other suitable hinge or fastening mechanism.

As in the prior embodiment, the housing 16 further includes flexible protrusion 40. Each flexible protrusion 40 protrudes from housing 16 at a predetermined angle A ranging from about zero degrees to about ninety degrees (need to show this on the drawing). Flexible protrusions 40 compensates for the thickness differences in varying substrates 66 (See FIG. 16) and also stabilizes housing 16 on the substrate 66 to prevent movement of connector 10 on substrate 66 once attachment point 32 is secured to substrate 66. Flexible protrusions 40 rigidly angularly displace to exert a force against substrate 66 to prevent movement of connector 10 on substrate 66. When flexible protrusions 40 displace, the predetermined angle is increased, which exerts a force against the substrate 66. In this exemplary embodiment, housing 16 includes two flexible protrusions 40, with each one of the two flexible protrusions 40 protruding from an opposing outside surface of housing 16. In another exemplary embodiment, the flexible protrusions may be omitted.

Figure 8:
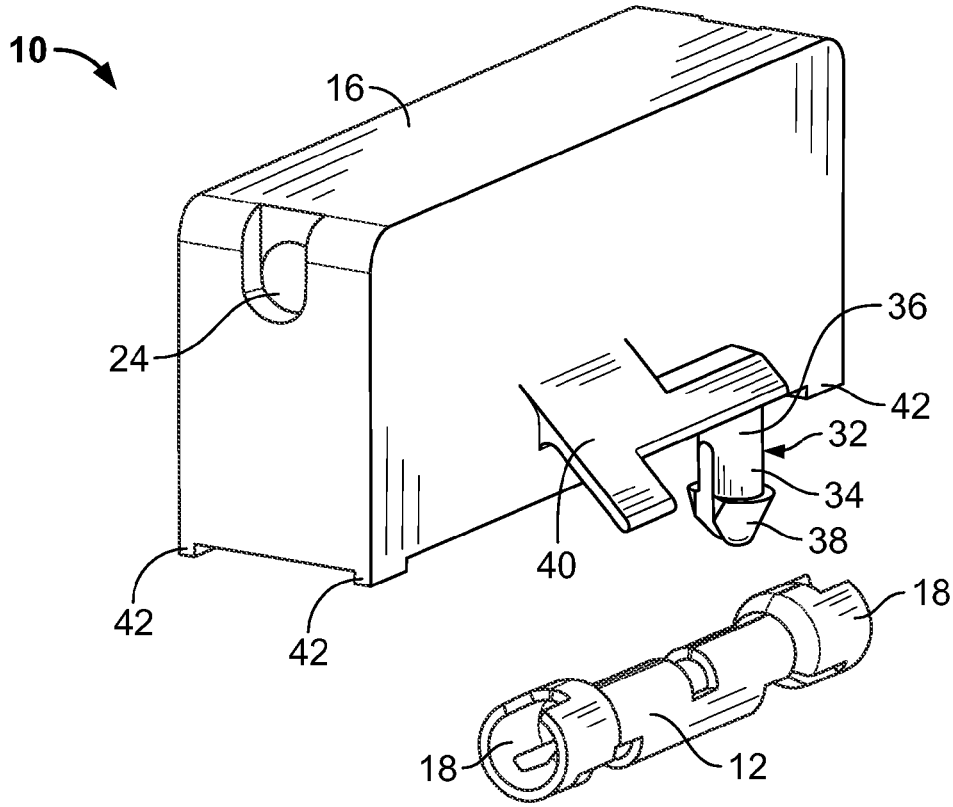
FIG. 8 shows a partially exploded view of an alternate embodiment of a dual ended poke in connector in accordance with an embodiment of the present invention.
Figure 9:
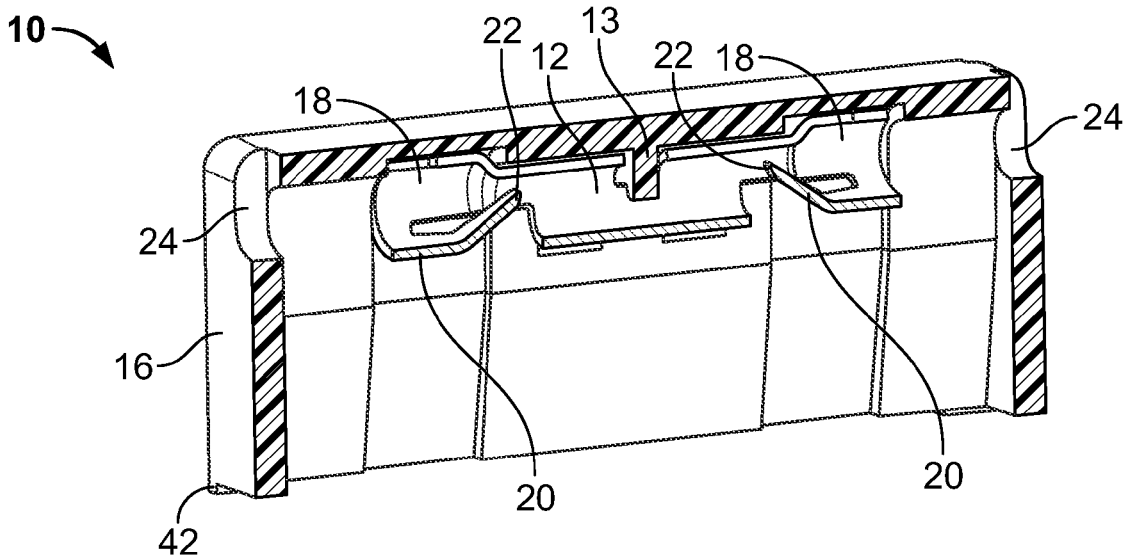
FIG. 9 shows a cross-sectional view of the connector of FIG. 8.

Referring now to FIGS. 8 and 9, yet another exemplary embodiment of connector 10 is shown. In this exemplary embodiment, connector 10 includes a housing 16 and contact 12. Housing 16 may be a unitary member having five sides, with one open side. For example, a rectangular configuration with an open bottom, as shown specifically in FIG. 8. Housing 16 includes a cavity or recess 14 for receiving contact 12. An injection molding process, or any other suitable process is used to manufacture housing 16 from a non-conductive material, such as plastic. Contact 12 is inserted into housing 16 through the open side and secured in housing 16. Contact 12 may be secured in receptacle 24 by a pressure fit, an adhesive or other suitable fastening means.

Referring specifically to FIG. 9, a cross sectional view of connector 10 is shown. A contact, or multiple contacts 12, is placed inside a cavity 14 of a housing 16. In addition to openings 18, contact 12 also includes a lance 20, at each opening 18. Lance 20 may be unitary with contact 12 and manufactured from a conductive material. When a conductive cable 60 (See FIG. 15) is inserted into opening 18, lance 12 deforms to allow conductive cable to be inserted into contact 12. Once conductive cable is inserted into contact 12, lance 20 is in contact with the conductive cable 60 (See FIG. 15). As a removal force is applied to the conductive cable 60 (See FIG. 15) a sharp end 22 of lance 20 engages with the conductive cable 60 (See FIG. 15) and prevents the extraction of conductive cable 60 (See FIG. 15) from contact 12.

Contact 12 may also include a tab 13 disposed in contact 12 to prevent the over insertion of a conductive cable 60 (See FIG. 15) into contact 12. Tab 13 is disposed at a predetermined location within contact 12, for example, the center of contact 12, and may be of unitary construction with contact 12. Barricade 13 may also be unitary with housing 16 and protrude inward toward the center of contact 12. Contact 12 may be manufactured with a stamping process or any other suitable manufacturing process from any electrically conductive material suitable for electrical communication, for example, a copper alloy material. One embodiment of contact 12 includes a cylindrical configuration having openings 18 on each end for receiving a conductive cable 60 (See FIG. 15). While a cylindrical configuration is described, any suitable configuration may be used for contact 12.

Housing 16 may include a foot 42 or multiple feet, to provide vertical spacing between connector 10 and surface 66 (See FIG. 16). The vertical spacing may provide air circulation for cooling to connector 10. Housing 16 includes flexible protrusion 40. Each flexible protrusion 40 protrudes from housing 16 at a predetermined angle A ranging from about zero degrees to about ninety degrees (need to show this on the drawing). Flexible protrusions 40 compensates for the thickness differences in varying substrates 66 (See FIG. 16) and also stabilizes housing 16 on the substrate 66 to prevent movement of connector 10 on substrate 66 once attachment point 32 is secured to substrate 66. Flexible protrusions 40 rigidly angularly displace to exert a force against substrate 66 to prevent movement of connector 10 on substrate 66. When flexible protrusions 40 displace, the predetermined angle is increased, which exerts a force against the substrate 66. In this exemplary embodiment, housing 16 includes two flexible protrusions 40, with each one of the two flexible protrusions 40 protruding from an opposing outside surface of housing 16. In another exemplary embodiment, the flexible protrusions may be omitted.

Figure 10:
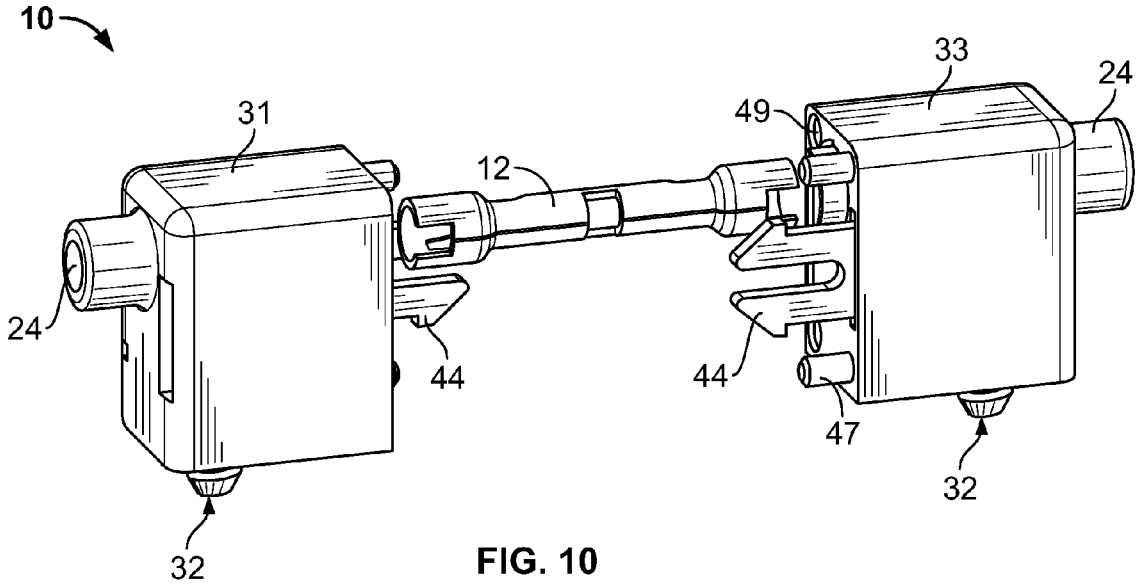
FIG. 10 shows a partially exploded view of an embodiment of a connector.
Figure 11:
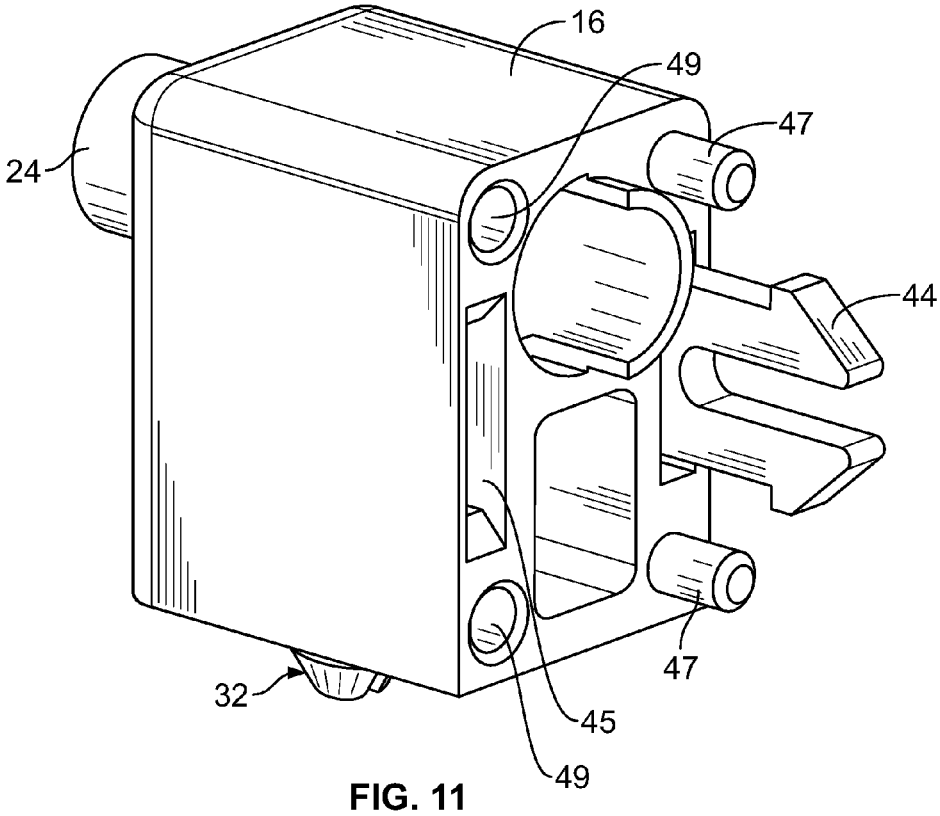
FIG. 11 shows the internal construction of a portion of the connector of FIG. 10.
Figure 12:
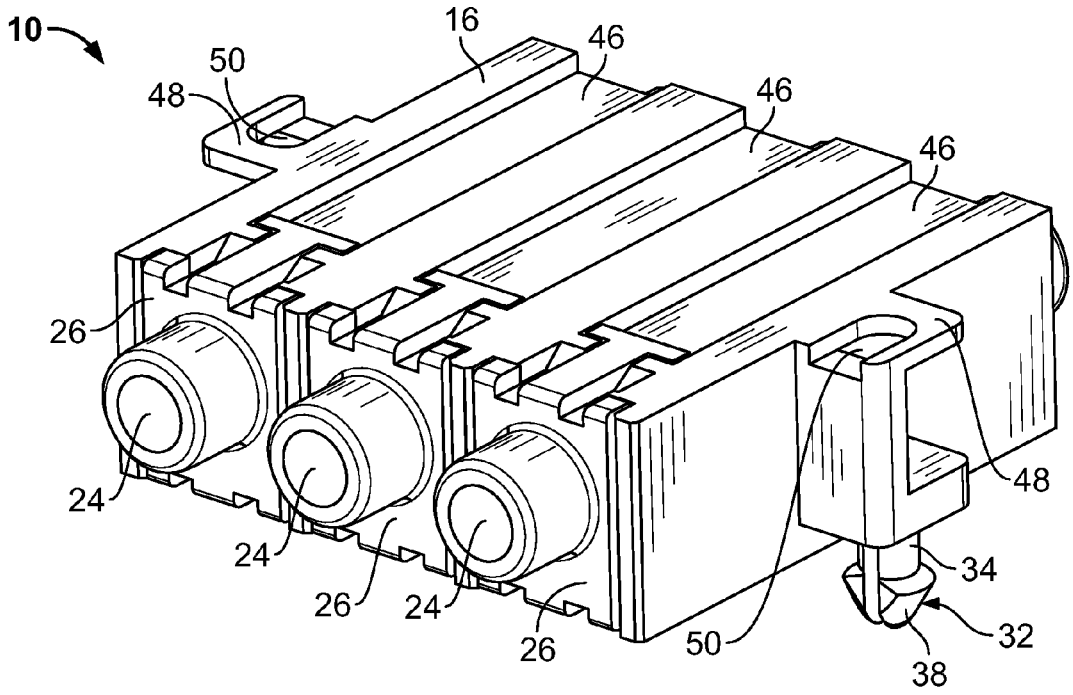
FIG. 12 shows a perspective view of an alternate embodiment of a dual ended poke in connector in accordance with an embodiment of the present invention.
Figure 13:
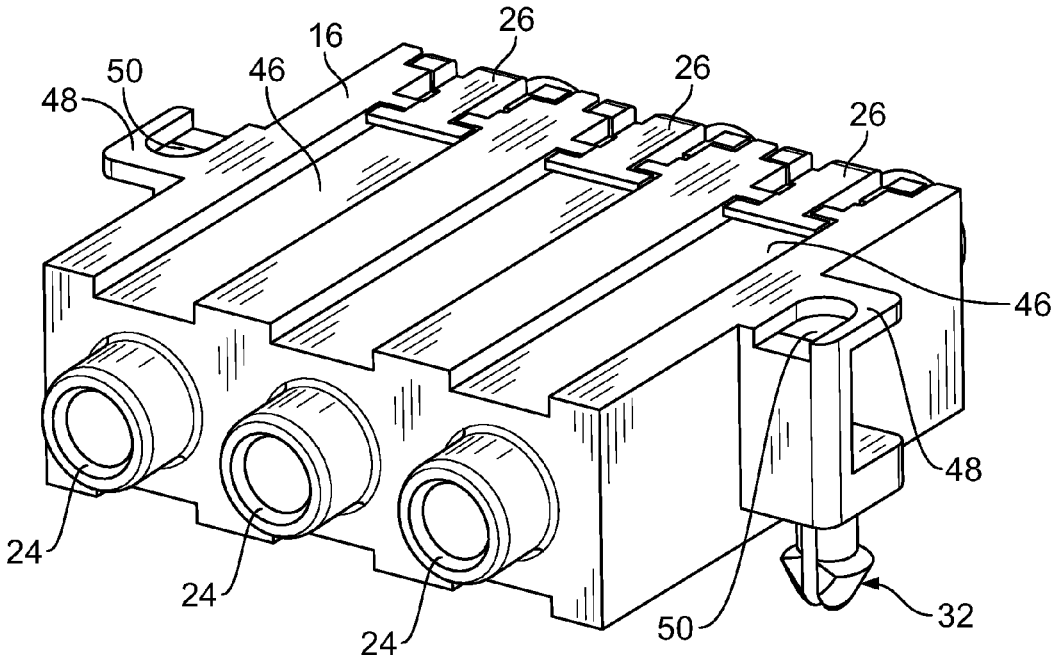
FIG. 13 shows perspective view of an opposite end of the connector of FIG. 14.

FIGS. 10 and 11 show another embodiment of connector 10. Connector 10 includes housing 16 and contact 12. Housing 16 includes a cavity or recess 14 for receiving contact 12. An injection molding process, or any other suitable process is used to manufacture housing 16 from a non-conductive material, such as plastic. Housing 16 may have a rectangular configuration or any other suitable configuration to receive and secure contact 12, or multiple contacts 12, while also being configured for placement in any environment, including space-limited areas. Housing 16 includes a receptacle 24 for receiving conductive cables 60 (See FIG. 15). Receptacle 24 is formed in housing 16 to align with the end of contact 12 and permit conductive cable 60 to enter contact 12 when inserted through receptacle 24.

If rotated one hundred and eighty (180) degrees, housing 16 mates into a second housing 16 and substantially enclose and substantially isolates contact 12. Housing 16 may include a latch 44 that engages with latch aperture 45 when a first housing 31 is mated with a second housing 33 to secure first housing 31 with second housing 33. Alignment posts 47 mate with alignment apertures 49 to aid in the mating of first housing 31 with a second housing 33 to substantially isolate contact 12.

A contact, or multiple contacts 12, is placed inside a cavity 14 of a housing 16. Contact 12 may be manufactured with a stamping process or any other suitable manufacturing process from any electrically conductive material suitable for electrical communication, for example, a copper alloy material. One embodiment of contact 12 includes a cylindrical configuration having openings 18 on each end for receiving a conductive cable 60 (See FIG. 15). While a cylindrical configuration is described, any suitable configuration may be used for contact 12.

Housing 16 may also include an attachment point 32 for securing connector 10 to surface 66 (see FIG. 16). FIGS. 10 and 11 show two attachment points 32 protruding from housing 16, however, any number of attachment points 32 may be used. Attachment point 32 may include two substantially parallel sections 34 protruding from a base 36. At the end of attachment point 32 opposite base 36, each parallel section 34 has a ledge 38 for retention in a surface 66 (See FIG. 16). As attachment point 32 is inserted into a surface 66 (See FIG. 16), parallel sections 34 are flexed inward toward each other. Once ledge 38 passes through the surface 66 (See FIG. 16), parallel sections 34 return to a substantially parallel position and are no longer flexed inward toward each other. Ledge 38 prevents connector 10 from being removed from the surface 66 (See FIG. 16) without the use of a tool, device, or other suitable actuation means.

FIGS. 12, 13, 14, 15 and 16 show another exemplary embodiment of connector 10. Connector 10 includes a housing 16 and contact 12. In this exemplary embodiment housing 16 includes three cavities 14 extending the length of housing 16 for receiving contacts 12. Housing 16 includes alignment feature 24 for receiving conductive cables 60 (See FIG. 15) and guiding conductive cable 60 (See FIG. 15) into contact 12. Cover 26 secures contact 12 in housing 16 when cover 26 is closed on housing 16. Cover 26 may secure to housing 16 by a snap in fit or other suitable retention means such as a fastener. Cover 26 includes alignment features 24 for guiding conductive cable 60 (see FIG. 15) into contact 12. Cover 26 may be color coded via molding compound colors during manufacture.

Housing 16 further includes a groove or multiple grooves 46 on the surfaces to guide and/or retain cover 26 onto housing 26. Grooves 46 are formed in housing 16 and extend the length of housing 16. Grooves 46 may also be protrusions that extend above the surface of housing 16. Mounting tabs 48 extend from the top surface of housing 16, and include an aperture 50 and attachment point 32. Attachment point 32 may include two substantially parallel sections 34 protruding from a base 36. At the end of attachment point 32 opposite base 36, each parallel section 34 has a ledge 38 for retention in a surface 66 (See FIG. 16). As attachment point 32 is inserted into a surface 66 (See FIG. 16), parallel sections 34 are flexed inward toward each other. Once ledge 38 passes through the surface 66 (See FIG. 16), parallel sections 34 return to a substantially parallel position and are no longer flexed inward toward each other. Ledge 38 prevents connector 10 from being removed from the surface 66 (See FIG. 16) without the use of a tool, device, or other suitable actuation means.

Referring specifically to FIG. 16, multiple connectors 10 may be stacked on top of one another to form a multiple-connector apparatus. Grooves 46 on the top of a first connector 10 align and mate with grooves 46 on the bottom of a second connector 10. The retention snap-in peg of the second connector 10 engages with aperture 50 of mounting tab 48 of the first connector 10. Connectors 10 may be stacked to fit into space-restrained areas, such as under a roof 62 or other suitable cover. The bottom connector 10 may be secured to a mounting plate 66 or other suitable device.

Figure 14:
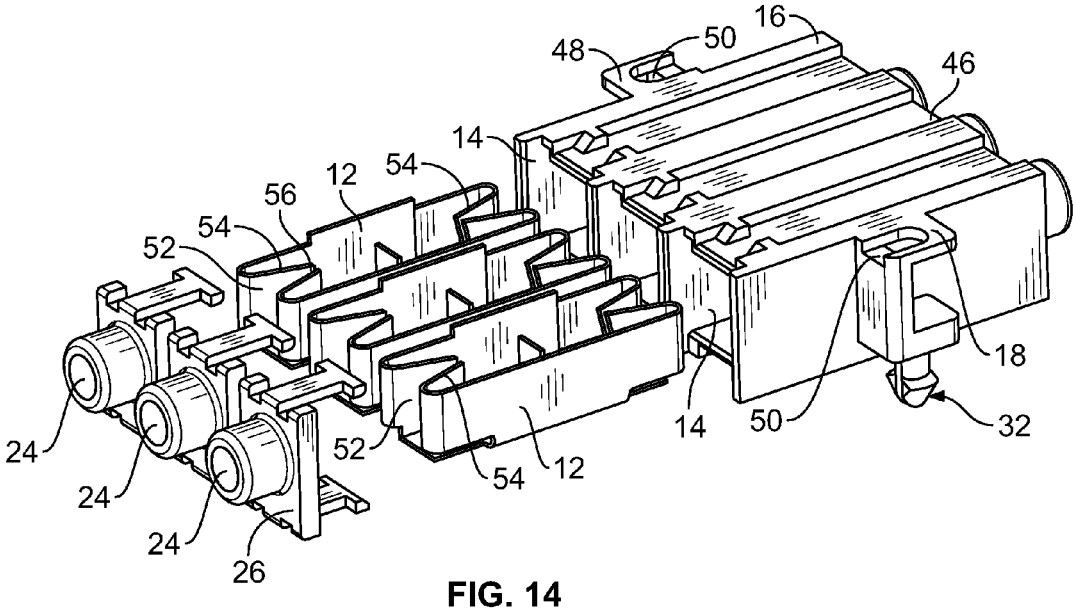
FIG. 14 shows a partially exploded view of the connector of FIG. 14.
Figure 15:
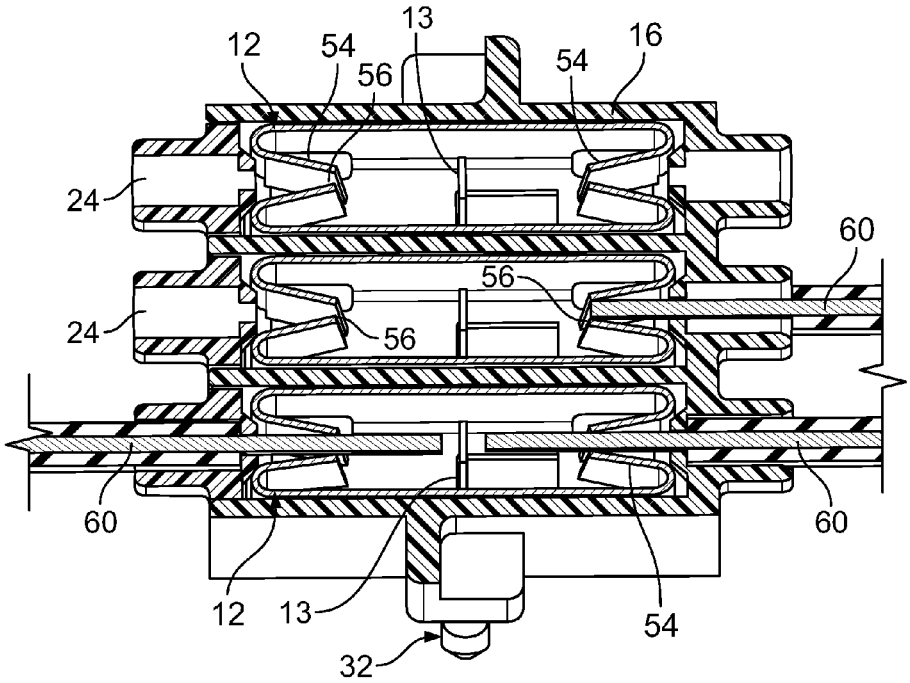
FIG. 15 shows a cross sectional view of the connector of FIG. 14.

Referring specifically to FIGS. 14 and 15, connector 10 includes housing 16, cover 26, and contacts 12. Contacts 12 may be manufactured from a stamping process or any other suitable process from any suitable electrically conductive material suitable as a contact, for example, a copper alloy material. In addition, contact 12 has a receptacle 52 on each end for receiving conductive cable 60. Receptacle 52 includes a lance 54, or multiple lances 54 for securing the conductive cable 60 once the conductive cable 60 is inserted into receptacle 52. Lances 54 protrude inward at an angle ranging between about zero and about ninety degrees so that the ends 56 of lances 54 are angled toward each other. End 56 of the first lance 54 may or may not be in contact with end 56 of second lance 54. End 56 may be tapered or beveled with a sharp edge to penetrate into the conductive cable 60 and prevent the conductive cable 60 from being removed from connector 10 once the conductive cable 60 has been inserted into connector 10. Contact 12 is inserted into cavity 14 of housing 16. Cavity 14 may be a separate compartment for each contact 12, or cavity 14 may be one large cavity 14 portion configured to accept multiple contacts 12 to accommodate receptacles 24. Each cavity 14 may have a contact 12 for receiving and retaining a conductive cable 60.

FIGS. 17, 18, 19, and 20 show yet another embodiment of connector 10. Connector 10 includes a housing 16 and contacts 12. Housing 16 is a two-piece or multiple-piece housing with three cavities 14 for receiving three contacts 12. Housing 16 may be manufactured from an injection molding process or any other suitable manufacturing process and may be manufactured from a non-conductive material, for example, plastic. Contacts 12 are inserted into one side of housing 16 into cavities 12. The remaining portion of housing 16 is then assembled around contact 12 to surround or substantially surround contact 12. The multiple pieces, or portions, of housing 16 may include latches 44 which engage in the opposing housing 16 piece when the multiple pieces form a unitary housing unit 16 when assembled.

Figure 20:
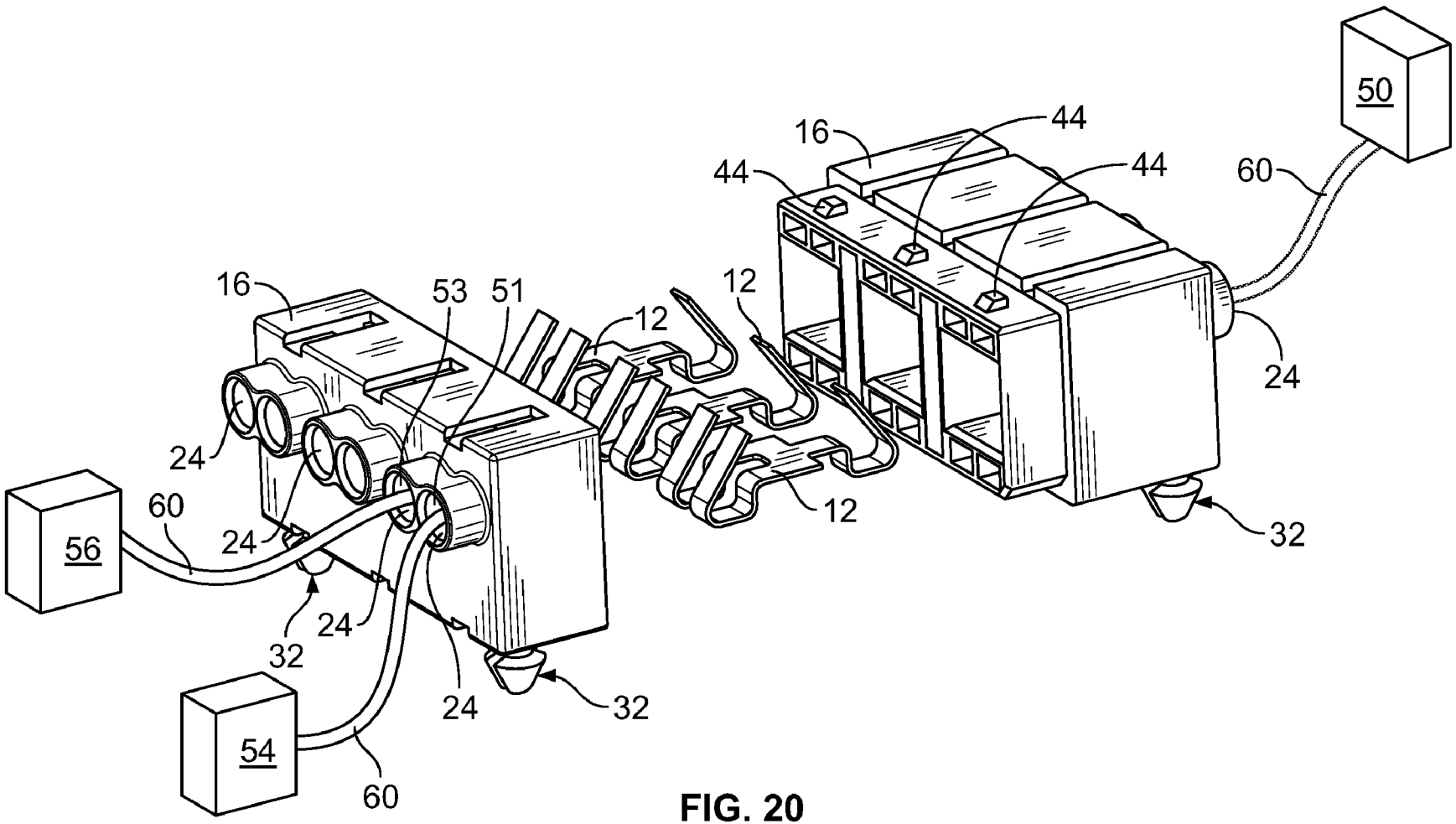
FIG. 20 shows an exemplary application of the connector FIG. 19.

Contact 12 is manufactured from a stamping process or other suitable process from any electrically conductive material suitable as a contact, for example, a copper alloy material. Conductive cables 60 are inserted into receptacles 24 and substantially contact contacts 12 to create electrically communication between the conductive cable 60 and contact 12. Referring to FIG. 20, contact 12 may provide electrical communication to multiple devices. For example, a single power source 50 may provide electrical power when conductive cable 60 is inserted into inlet 21. A first device 54 may be inserted into outlet 51 and a second device 56 may be inserted into outlet 53. Electrical power is conducted from single power source 50 to first device 54 and second device 56 inserted into outlet 23 and outlet 25. Alternately, two power sources (not shown) may be inserted into outlet 23 and outlet 25 to provide additional power to a single device inserted into inlet 21. It is understood that while the examples have been given above, any suitable type of device and connection may be made with connector 10 in FIGS. 17, 18 and 19.

Housing 16 also includes an attachment point 32 for securing connector to a base, circuit board, mounting plate 66 (See FIG. 16). Any suitable amount of attachment points 32 may be used. Attachment point 32 may include two substantially parallel sections 34 protruding from a base 36. At the end of attachment point 32 opposite housing 16, each section 34 has a ledge 38 for retention in the mounting plate 66 (See FIG. 16). As attachment point 32 is inserted into the mounting plate 66 (See FIG. 16), sections 34 are flexed inward toward each other. Once ledge 38 passes through the aperture (not shown), sections return to a substantially parallel position and are no longer flexed inward toward each other.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector comprising:

an electrically conductive contact;

a housing comprising:

a cavity configured to receive and secure the contact;

a first alignment feature for guiding a first conductive cable into the contact;

a second alignment feature for guiding a second conductive cable into the contact;

at least one attachment point protruding from the housing, the attachment point configured to attached and secure the connector to a surface;

a cover attached to the housing, the cover comprising a cover attachment point, the cover attachment point configured to attach and secure the connector to a surface; and wherein the contact being configured to receive and secure the first conductive cable and the second conductive cable to provide an electrical connection between the first conductive cable and the second conductive cable.

2. The connector of claim 1, wherein the cover is hingedly attached to the housing and rotatable about the hinge.

3. The connector of claim 1, wherein the attachment point comprises at least two substantially parallel portions deformable towards one another during attachment to a substrate.

4. The connector of claim 3, wherein the attachment point further comprises a retention feature configured to securely attach the connector to the substrate.

5. The connector of claim 1, wherein the at least one attachment point protrudes from a bottom surface of the housing.

6. The connector of claim 1, wherein the contact comprises a conductive cable engaging mechanism for securing the first conductive cable and the second conductive cable to the contact.

7. The connector of claim 1, wherein the housing is manufactured from a non-conductive material.

8. The connector of claim 1, wherein the housing comprises at least one flexible flange extending from an exterior surface of the housing, the flexible flange configured to substantially prevent movement of the connector on the surface.

9. The connector of claim 1, wherein the housing comprises an aperture for receiving an attachment point of an additional housing, wherein multiple housings may be vertically stacked, the aperture of a first housing receives and secures the attachment point of an additional housing.

10. A connector for mounting on a substrate, the connector comprising:

an electrically conductive contact;

a housing comprising:

a cavity configured to receive and secure the contact;

a first alignment feature for guiding a first conductive cable into the contact;

a second alignment feature for guiding a second conductive cable into the contact;

at least one attachment point protruding from the housing, the attachment point configured to attached and secure the connector to a surface;

at least one flexible flange extending from an exterior surface of the housing, the flexible flange configured to displace to compensate for the thickness of the substrate and to substantially prevent movement of the connector on a surface; and a cover attached to the housing, the cover comprising a cover attachment point, the cover attachment point configured to attach and secure the connector to a surface; and wherein the contact being configured to receive and secure the first conductive cable and the second conductive cable to provide an electrical connection between the first conductive cable and the second conductive cable, and wherein the flexible flange exerts a force against the substrate as the flexible flange is displaced.

11. The connector of claim 10, wherein the cover is hingedly attached to the housing and rotatable about the hinge.

12. The connector of claim 10, wherein the attachment point comprises at least two substantially parallel portions deformable towards one another during attachment to a substrate.

13. The connector of claim 12, wherein the attachment point further comprises a retention feature configured to securely attach the connector to the substrate.

14. The connector of claim 10, wherein the at least one attachment point protrudes from a bottom surface of the housing.

15. The connector of claim 10, wherein the housing is not easily movable from the surface once the housing is secured to the surface.

16. The connector of claim 10, wherein the housing is manufactured from a non-conductive material.

17. The connector of claim 10, wherein the housing is manufactured from an injection molding process.

18. The connector of claim 10, wherein the housing comprises an aperture for receiving an attachment point of an additional housing, wherein a plurality of housings may be vertically stacked, the aperture of a first housing receives and secures the attachment point of an additional housing.

* * * * *